US005461363A

United States Patent [19]

Chang

[11] Patent Number: 5,461,363

[45] Date of Patent: Oct. 24, 1995

[54] ALARM APPARATUS CONTAINING SECURITY AND SAFETY MONITORS

[76] Inventor: Ming-Sheng Chang, 1st Fl., No. 7, Lane 740, Sec. 5, Chung Shan N. Rd., Taipei, Taiwan

[21] Appl. No.: 16,241

[22] Filed: Feb. 11, 1993

[51] Int. Cl.[6] ..... G08B 13/02; G08B 13/08; G08B 17/06

[52] U.S. Cl. ..... 340/521; 340/541; 340/545; 340/566; 340/595; 200/61.71; 200/61.74

[58] Field of Search ..... 340/521, 541, 340/545, 566, 595, 584; 200/61.72, 61.74, 61.71, 61.93

[56] References Cited

U.S. PATENT DOCUMENTS

| | | | |
|---|---|---|---|
| 2,943,308 | 6/1960 | Westphal | 340/545 |
| 2,984,718 | 5/1961 | Fish | 200/61.72 |
| 3,091,760 | 5/1963 | Spenard et al. | 340/545 |
| 3,618,062 | 11/1971 | Ott | 340/566 |
| 3,634,840 | 1/1972 | Wilkinson | 340/595 |
| 3,641,571 | 2/1972 | Kitman | 340/521 |

OTHER PUBLICATIONS

Security Distributing & Marketing, Nov. 1991, pp. 21, 31, 79, 91 and 97.
Linear Alert, Linear Corporation, 1988.
Security Sales, Vol. 15, No. 5, May 1993, pp. 37, 41, 49, 78, 100, 114 and 130.
Napco Brochure, 1992.
Visonic Ltd. Advertisement.
Linear Advertisement, p. 23.
Caddx Controls Brochures#UL-5000 &#5002.
Security Sourcebook, 1993, pp. 64–83.

*Primary Examiner*—Glen Swann
*Attorney, Agent, or Firm*—Parkhurst, Wendel & Rossi

[57] ABSTRACT

A safety apparatus for a passage controlled by means of a first member and a second member, has a first device for detecting opening of the passage, a second device for detecting fierce knocking on the first and second members and a third device for detecting abnormally high temperature. The first device detects relative movement between the first and second members. The first device has (a) a block being attached to the first member and having a curved surface, (b) a detector having a casing attached to the second member and a pin having a free end so that the pin is in various positions relative to the casing when the free end of the pin is in various positions against the curved surface of the block as the first member is moved relative to the second member and (c) an alarm actuated by means of the detector for warning of the relative movement between the first member and second members. The second device has a microphone for detecting noise caused by vibration of, as a function of knocking on, at least one of the first and second members. The third device has a thermistor for detecting temperatures.

4 Claims, 7 Drawing Sheets

ALARM APPARATUS CONTAINING SECURITY AND SAFETY MONITORS

BACKGROUND OF INVENTION

Field of Invention

The present invention relates to an alarm apparatus containing security and safety monitors. More specifically, the present invention relates to a single alarm apparatus being capable of detecting unauthorized opening of doors and windows, of detecting fierce knocking on windows and doors and of detecting abnormally high temperature.

Related Prior Art

Conventionally, separate devices are respectively used for detecting unauthorized opening of doors and windows, for detecting fierce knocking on doors and windows and for detecting abnormally high temperature. However, there has not been any single apparatus providing both the above-mentioned functions. Therefore, the present invention is intended to provide a compact apparatus for providing the above-mentioned functions.

Furthermore, electromagnetic devices have been used for detecting fierce knocking on doors. Such an electromagnetic device has a magnet attached on a door and a sensor mounted on a wall. When the door is fiercely knocked, the magnet is sufficiently moved so that the sensor senses the change of magnetic field. Thus, the movement of the magnetism, i.e., the violent knocking on the door, is detected. However, when such a device is used for monitoring doors made of iron or steel, the doors will be induced with permanent magnet after being used for a period of time. Thus, the accuracy of such a device is affected. Therefore, the present invention is intended to solve this problem.

SUMMARY OF INVENTION

It is an object of the present invention to provide an alarm apparatus comprising a first device for detecting breakage of windows, a second device for detecting movement of windows and doors and a third device for detecting fire.

For a better understanding of the present invention and objects thereof, a study of the detailed description of the embodiments described hereinafter should be made in relation to the accompanying drawings.

DETAILED DESCRIPTION OF PREFERRED EMBODIMENT

The present invention will be described in detail with reference to the drawings showing the preferred embodiment of the present invention. The safety apparatus is capable of detecting undesired opening of windows or doors, capable of detecting fierce knocking on windows or doors and capable of detecting abnormally high temperatures.

Figure 1:
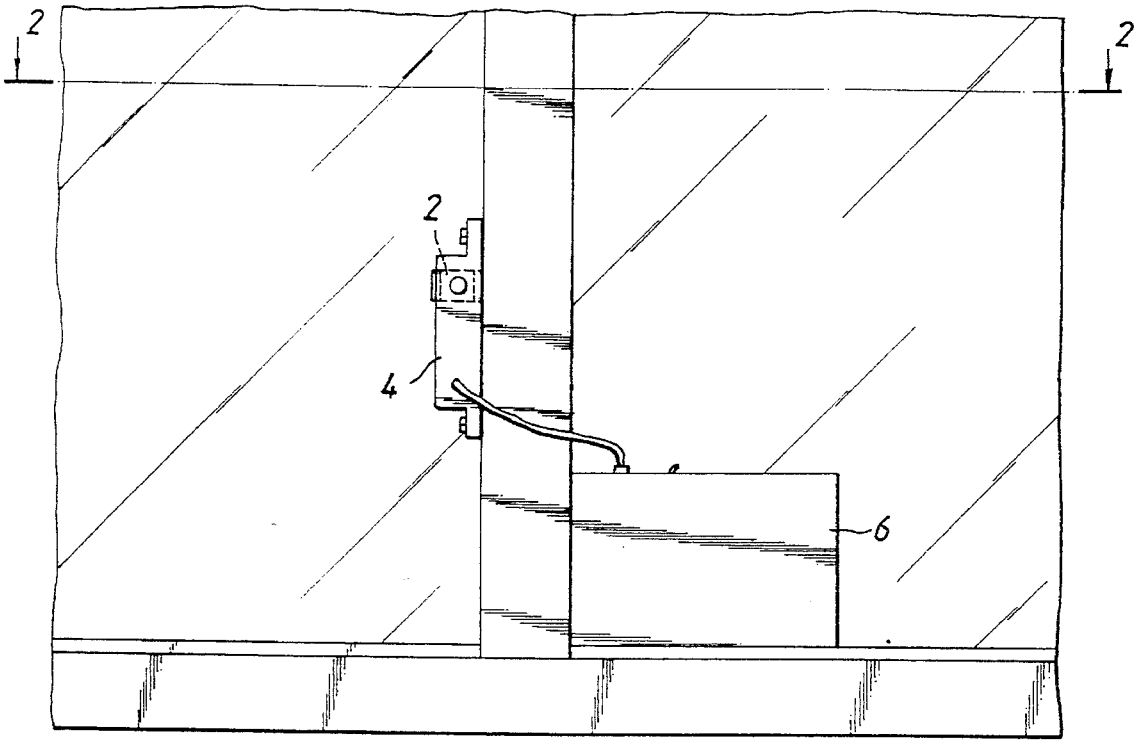
FIG. 1 is a front view of a safety apparatus mounted on a window in accordance with the preferred embodiment of the present invention.
Figure 2:
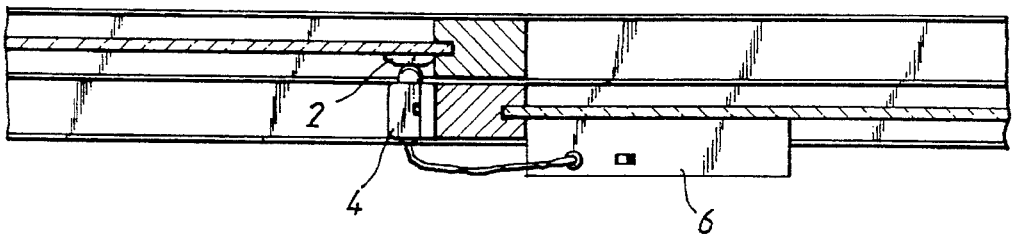
FIG. 2 is a horizontal cross-sectional view of a safety apparatus mounted on a window in accordance with the preferred embodiment of the present invention, taken along line 2—2.

Initially referring to FIGS. 1 and 2, the safety apparatus is used to monitor a window having a first glass panel enclosed by a first frame and a second glass panel enclosed by a second frame. The first frame is slidable with respect to the second frame, i.e., the first glass panel is slidable relative to the second glass panel.

The safety apparatus has a block 2. The block 2 is mounted on the first glass panel in order to function as an index. As clearly seen in FIG. 2 illustrating the preferred embodiment, the block 2 has a trapezoidal form. That is, the block 2 has a free vertical surface consisting of a middle section extending parallel to the first glass panel and two lateral slopes declining from the middle section to the first glass panel. Although the block 2 has a trapezoidal form in the preferred embodiment, the free vertical surface of the block 2 can have any form with a middle portion relatively distal from the first glass panel and two lateral portions declining from the middle portion to the first glass panel, i.e., a curved form.

The safety apparatus further has a first casing 4 for containing some electrical parts and mechanical parts. The first casing 4 is mounted on a vertical member of the second frame. The block 2 is partially hidden behind the first casing 4 as shown in FIG. 1.

The safety apparatus further has a second casing 6 for containing further electrical parts. The second casing 6 is attached to the second glass panel.

Figure 3:
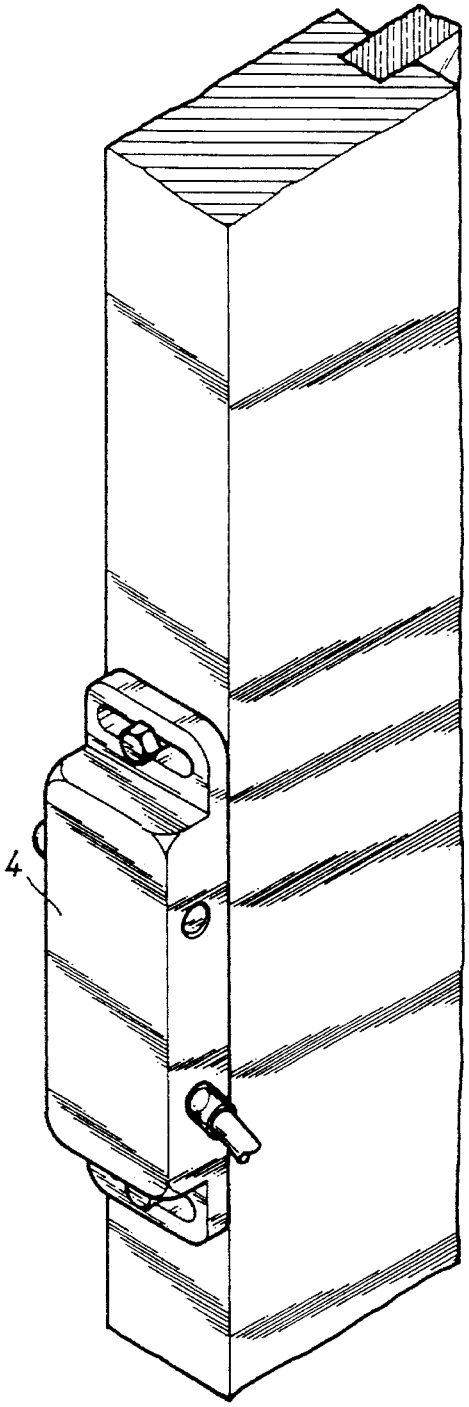
FIG. 3 is a perspective view of a casing containing some elements in accordance with the preferred embodiment of the present invention, showing the casing mounted on a first type of glass-panel frame.

Additionally referring to FIG. 3, a first type of vertical member of the second frame has a plain edge wide enough for receiving screws. The first casing 4 has two flanges laterally extending therefrom. Each of the flanges has one slot. Two screws are inserted through the slots so as to be secured in the edge, so that the first casing 4 is mounted on the edge. The slots allow the adjusting of the first casing 4 with respect to the block 2.

Figure 4:
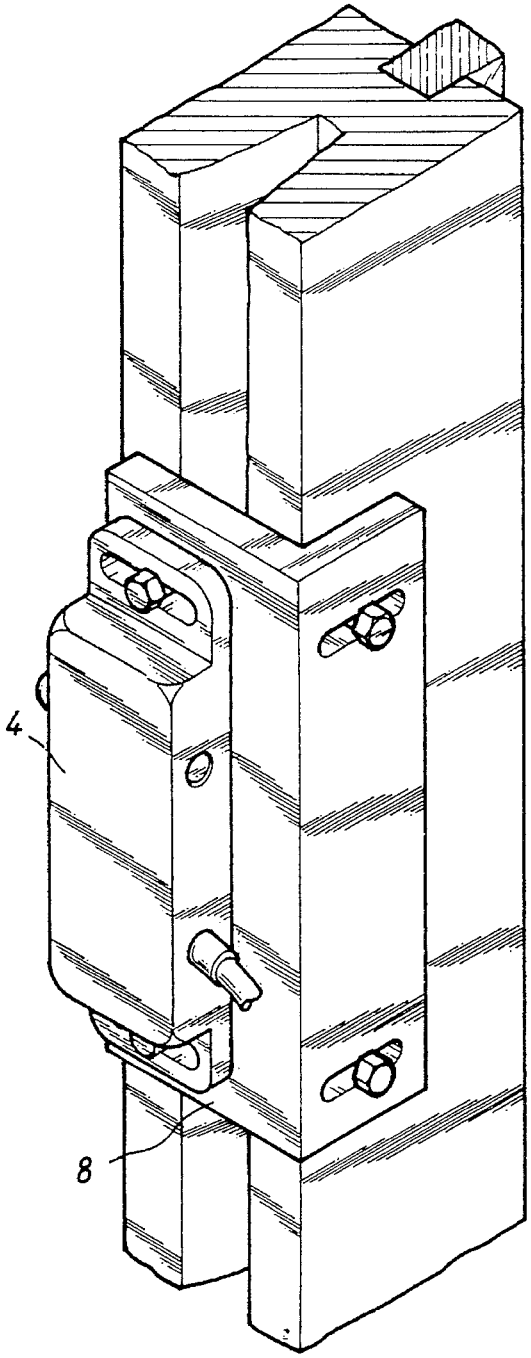
FIG. 4 is a perspective view of a casing containing some elements in accordance with the preferred embodiment of the present invention, showing the casing mounted on a second type of glass-panel frame by means of a brace.

Additionally referring to FIG. 4, a second type of vertical member of the second frame has an edge separated into two blades by means of a groove. The blades are not wide enough for receiving screws. A brace 8 has a first member perpendicularly integrating with a second member. The first member of the brace 8 has two slots extending therein. The second member of the brace 8 has two slots extending therein. Two threaded bolts protrude through the slots formed in the flanges formed on the first casing 4 and the slots formed in the first member of the brace 8, so as to engage with two threaded nuts, so that the first casing 4 is mounted on the brace 8. Two screws are inserted through the slots formed in the second member of the brace 8 so as to be secured in one of the blades, so that the first casing 4 is mounted on the second type of vertical member of the second frame by means of the brace 8.

Figure 5:
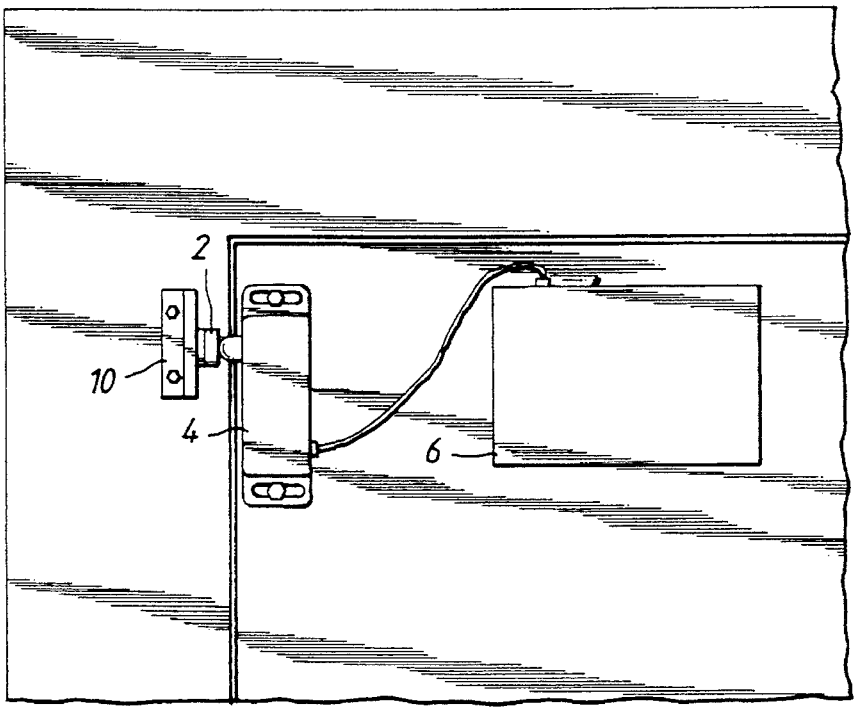
FIG. 5 is a front view of a first arrangement of a safety apparatus mounted on a door in accordance with the preferred embodiment of the present invention.

Additionally referring to FIG. 5, the security apparatus is used for monitoring a door. The block 2 is attached to a brace 10 mounted on a wall. The first casing 4 and the second casing 6 are mounted on a door.

Figure 6:
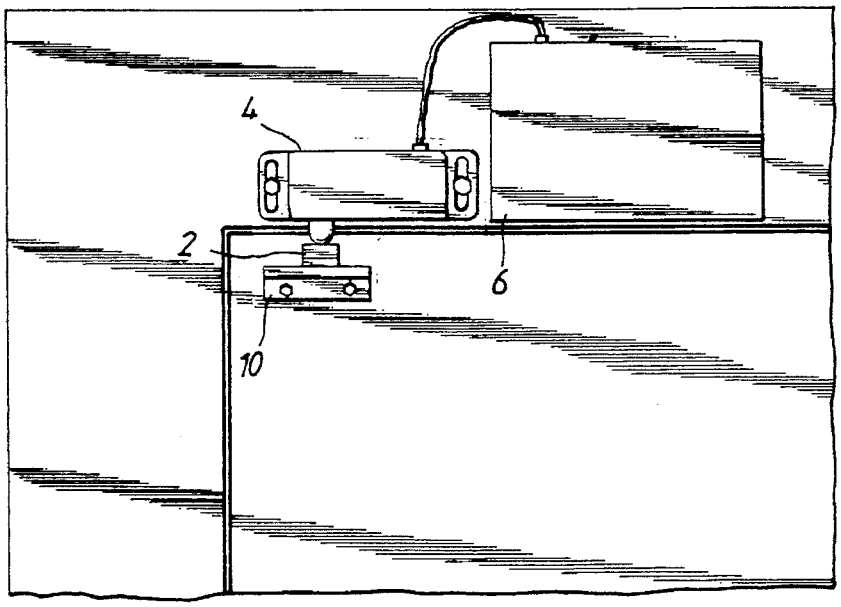
FIG. 6 is a front view of a second arrangement of a safety apparatus mounted on a door in accordance with the preferred embodiment of the present invention.

Additionally referring to FIG. 6, in an alternative arrangement, the block 2 is attached to a brace 10 mounted on a door. The first casing 4 and the second casing 6 are mounted on a wall.

Figure 7:
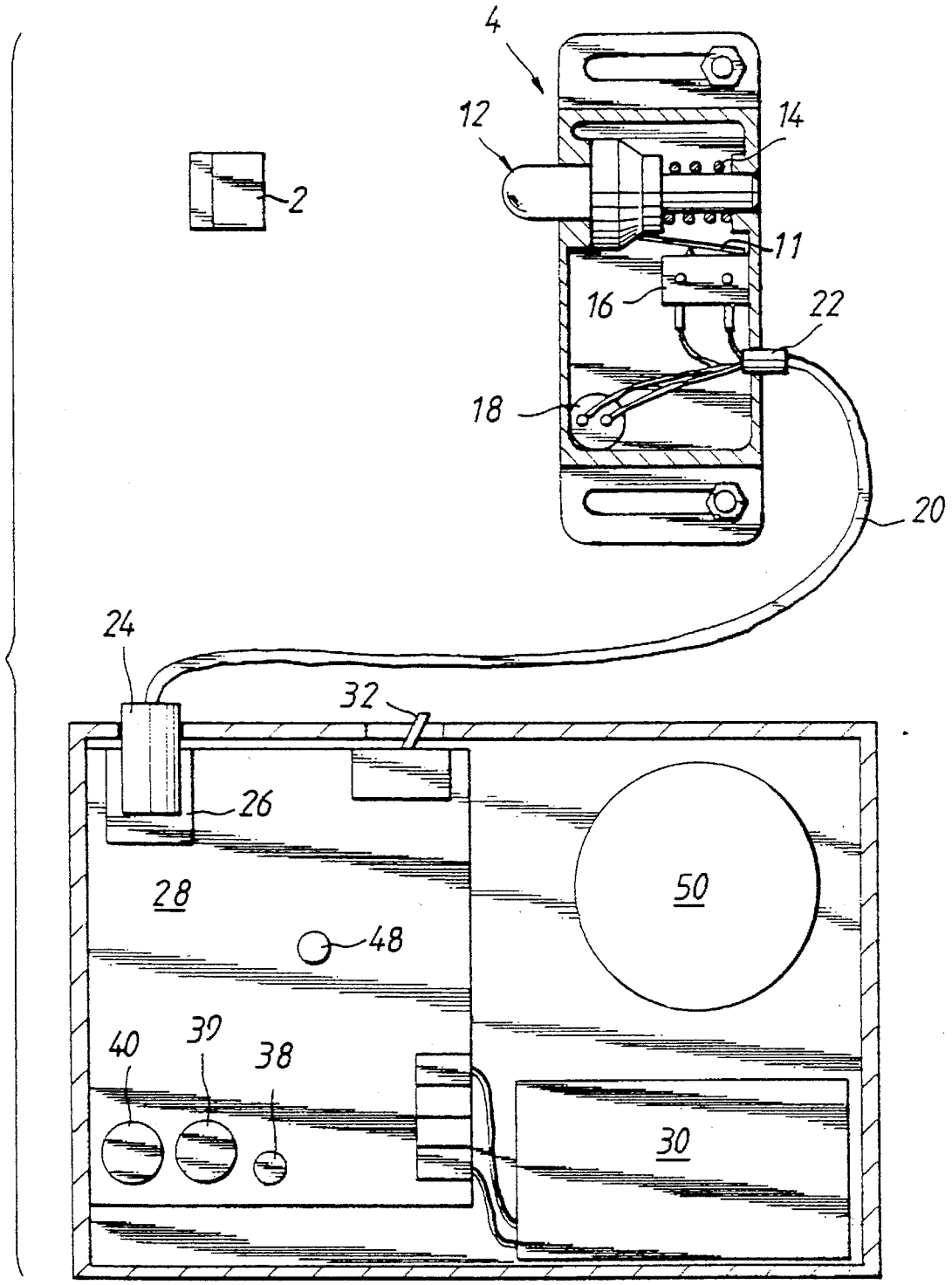
FIG. 7 is a view of a safety apparatus in accordance with a first embodiment of the present invention.

Additionally referring to FIG. 7, details of the security apparatus are given. The first casing 4 has a first wall extending parallel to a second wall thereof. The first wall defines a first hole and the second wall defines a second hole. A pin 12 has a first end protruding through the first hole defined in the first casing 4 and a second end projecting through the second hole defined in the first casing 4. The pin 12 further has a relatively large middle portion. The second end of the pin 12 is inserted through a spring 14 compressed between the relatively large middle portion of the pin 12 and the second wall of the first casing 4. The relatively large middle portion of the pin 12 has a conical surface abutting the tip of a lever extending from a microswitch 16 mounted in the first casing 4. When the pin 12 is pushed along a direction from the first wall to the second wall, the conical surface of the relatively large middle portion of the pin 12 pivots the lever 11 of the microswitch 16, so that the microswitch 16 is switched from a first position as shown in FIG. 7 to a second position.

Further referring to FIGS. 1 and 2, the pin 12 extends perpendicular to the first glass panel when the first casing 4 is mounted on the vertical member of the second frame. In operation, an initial position of the window, i.e., an initial relative position between the first and second glass panels, block 2 must be set. Regardless of the initial relative position between the first and second glass panels, the first end of the pin 12 must abut the middle surface of the block 2. Accordingly, the spring 14 is compressed, and the microswitch 16 is in NORMAL CLOSED.

Preferably, the initial relative position between the first and second glass panels occurs when the window is in the shut position. When the window is moved from the initial position, i.e., the first and second glass panels are moved with respect to each other, the block 2 is accordingly moved relative to the pin 12. When the first end of the pin 12 is relatively moved to one of the lateral slopes of the block 2 from the middle surface of the block 2, the first end of pin 12 is further pushed out of the first casing 4 as the relatively large middle portion of the pin is biased by means of the spring 14. The conical surface of the pin 12 allows the lever 11 to pivot so that the microswitch 16 is switched to NORMAL OPEN.

According to the above description, when the window is switched from the shut position to the open position, the microswitch 16 is switched from NORMAL CLOSED to NORMAL OPEN. That is, the opening of the window can be detected. In the illustrated embodiment, the microswitch 16 is in the first position when the window is shut. This is suitable for situations when the house is empty of any occupant.

Sometimes, it is desired that the initial position of the window is an open position, e.g., when at least one occupant is in the house and wants the window to be open for fresh air. In such a case, the window is firstly sited in a desired open position and the block 2 is mounted on the first glass panel such that the middle surface of the block 2 contacts the first end of the pin 12. The microswitch 16 is in NORMAL CLOSED when the window is at the desired open position. If the first glass panel is then moved relative to the second glass panel, the first end of the pin 12 contacts the lateral slopes of the block 2. The microswitch 16 is switched to NORMAL OPEN. Thus, the changing of the position of the window is detected.

As mentioned above, only one block 2 is used. However, a number of blocks 2 can be attached to the first glass panel at different positions, so that various initial positions of the window are possible.

Additionally referring to FIGS. 5 and 6, the safety apparatus is used for monitoring doors. The doors do not slide relative to the walls. However, when the doors pivot relative to the walls, the block 2 moves relative to the pin 12. Thus, the opening of the door can also be detected.

As well known, noise occurs when doors and windows are knocked. The noise is louder as the knocking is fiercer. Therefore, the noise can be interpreted as a function of knocking, if the noise is detected at a point close to the door and window. Referring to FIG. 7, a microphone 18 is mounted in the first casing 4, i.e., the microphone 18 is sited close to the door and window as the first casing 4 is mounted on the door and window. The microphone 18 detects noise and accordingly sends signals. Obviously, if arranged appropriately, the microphone 18 will be little affected by other noise than that caused by vibration of the door and the window.

A wire 20 has a first end electrically connected to a terminal 22 and a second end electrically connected to a terminal 24. The microswitch 16 and the microphone 18 are electrically connected to the terminal 22 in parallel. The terminal 24 engages with a port 26 formed in a circuit board 28 powered by a power supply 30, e.g., a battery. An on/off 32 is arranged in the circuit board 28.

Figure 8:
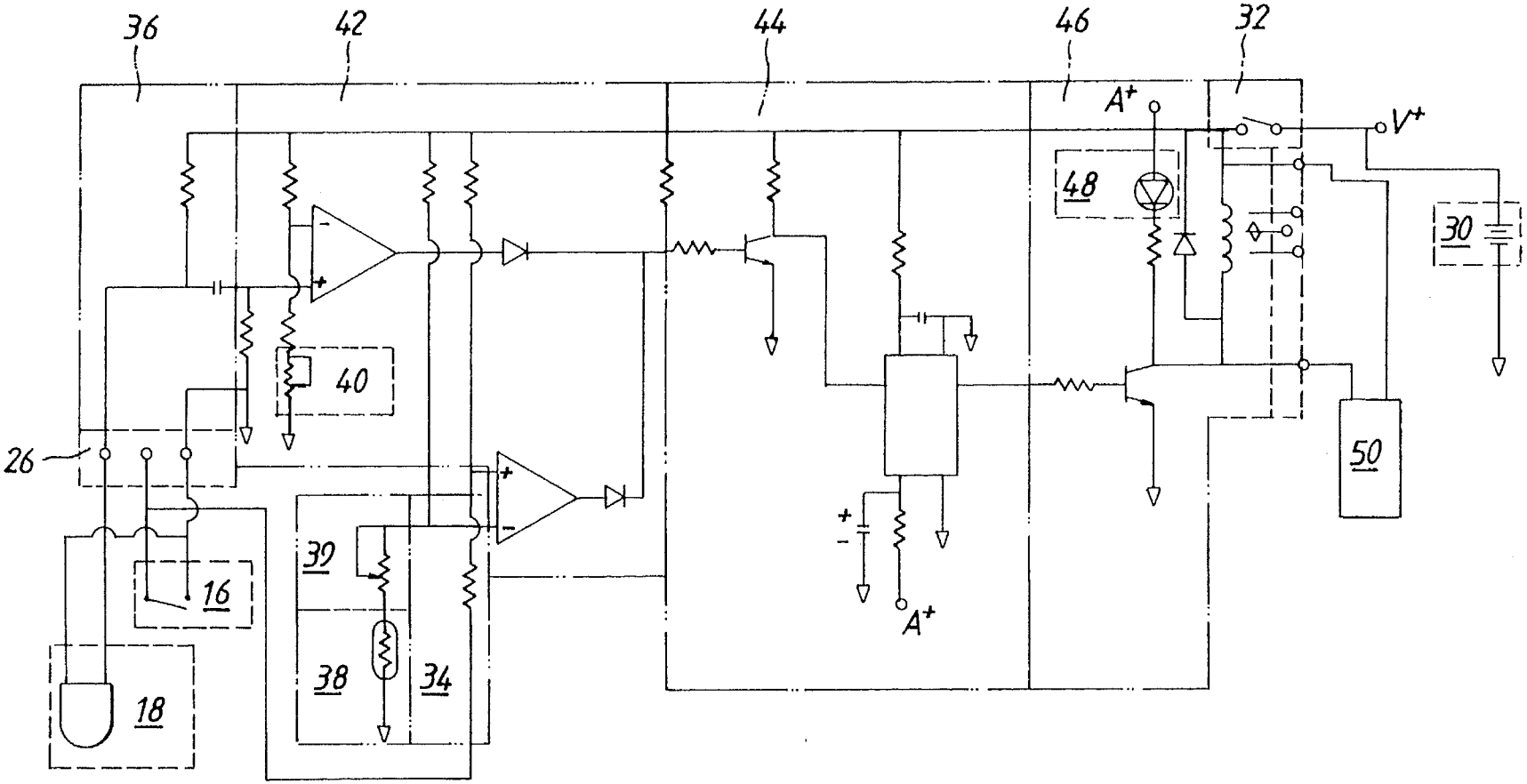
FIG. 8 is a schematic view of a circuit in accordance with a first embodiment of the present invention.

Additionally referring to FIG. 8, a circuit arranged in the circuit board 28 is shown. By means of the port 26, the microswitch 16 is electrically connected to a detecting stage 34. When relative movement between the glass panels occurs, the microswitch 16 is switched from NORMAL CLOSED to NORMAL OPEN.

By means of the port 26, the microphone 18 operatively connects with an attenuating stage 36 in the circuit. The attenuating stage 36 attenuates signals periodically transmitted from the microphone 18. The signals corresponds to the noises.. An adjusting stage 40 is arranged in the circuit for adjusting the sensitivity of the microphone 18.

A thermistor 38 is used in the circuit for detecting temperatures. An adjusting stage 39 is arranged in the circuit for adjusting the sensitivity of the thermistor 38.

The detecting stage 34, the attenuating stage 36 and the adjusting stage 39 are electrically connected to a comparing stage 42 in parallel. A predetermined noise-controlling value and a predetermined temperature-controlling value are loaded in the comparing stage 42. The microswitch 16 is electrically connected to the comparing unit 42. Signals transmitted from the microphone 18 are compared with the noise-controlling value. Signals transmitted from the thermistor 38 are compared with the temperature-controlling value. Responding to the comparing unit 42, a controlling unit 44 actuates an alarming stage 46 for turning on a light emitting diode 48 and a siren 50. Although shown in the second casing 6, the siren 50 can be mounted at a point relatively far from the second casing 6.

If the wire 20 is cut or broken, the alarming stage 46 will be actuated and the signals will be sent to the siren 50.

Figure 9:
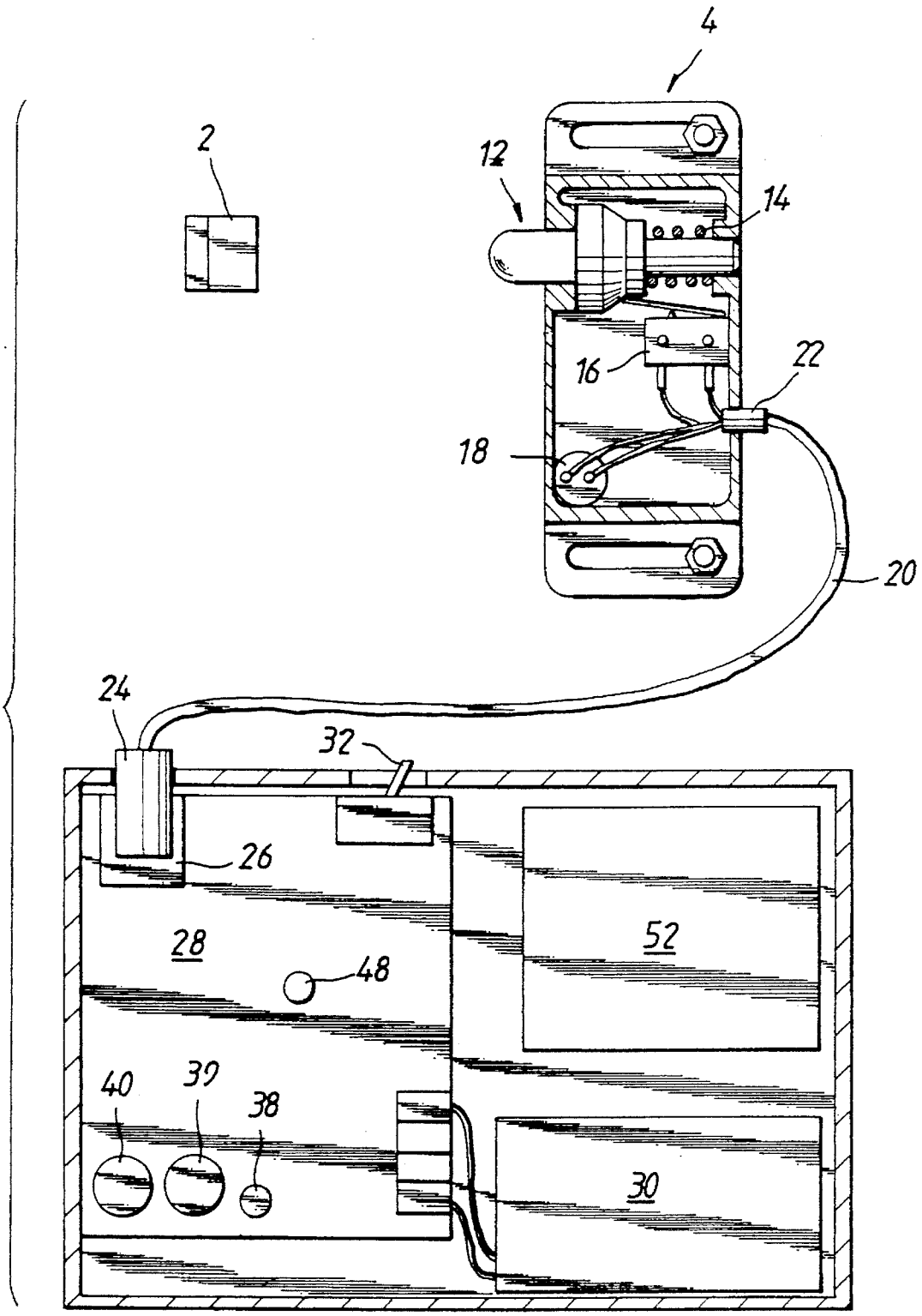
FIG. 9 is a view of a safety apparatus according to a second embodiment of the present invention.
Figure 10:
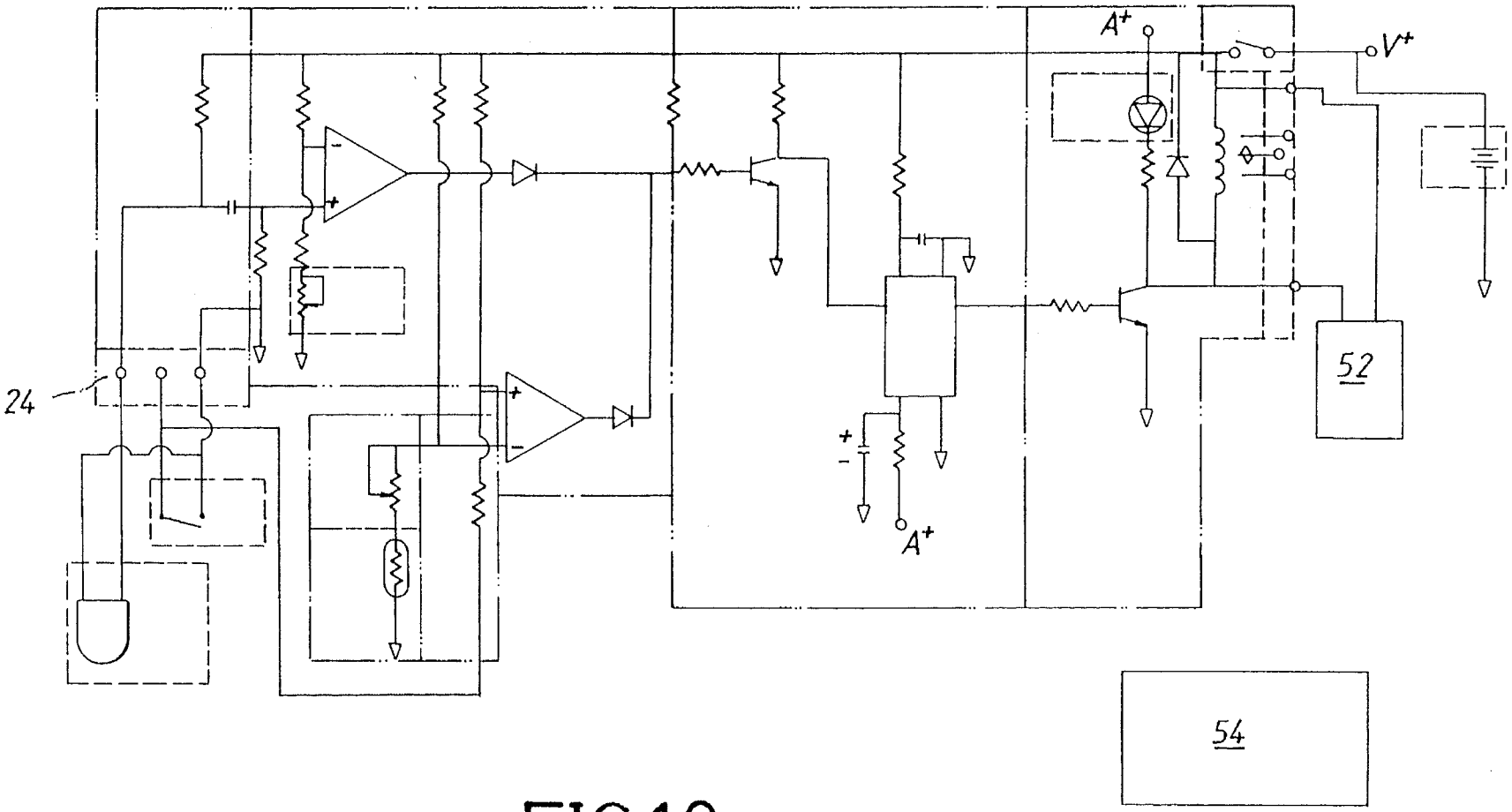
FIG. 10 is a schematic view of a circuit according to a second embodiment of the present invention.

Additionally referring to FIGS. 9 and 10, the siren 50 shown in FIGS. 7 and 8 is replaced with a wireless signal emitter 52 for sending signals to a receiver 54. The receiver 54 can incorporate an appropriate alarming/security device which will not be described in detail as not being the spirit .of the present invention.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A safety apparatus for a passage which is formed by opening a first member with respect to a second member from a closed position of the first member, said first member defining an interior and an exterior on opposite sides thereof, said safety apparatus comprising:

a detecting means including a block attached to one of said first and second members and having an operative surface, a casing attached to the other of said first and second members, and a pin partially received in said casing, said pin being slidable in said first casing such that when said member is in a closed position relative to the second member, said pin is in a retracted position by abutting contact against said operative surface, said detecting means generating a detecting signal upon movement of said first member relative to said second member whereby said pin and said operative surface are moved relative to each other such that the pin is in an extended position;

a microphone means for detecting noise caused by vibrations of at least one of said first and second members;

a thermistor means for detecting temperature in the interior; and an alarm which is electronically connected to said detecting means, said microphone means, and said thermistor means, wherein said alarm is actuated when at least one of: (a) a noise value detected by said microphone means exceeds a pre-determined value, (b) a temperature value detected by said thermistor means exceeds a pre-determined value, and (c) the detecting signal is generated by said detecting means.

2. The safety apparatus of claim 1 wherein said microphone means is provided in said casing.

3. The safety apparatus of claim 1, further comprising a power supply source for actuating said alarm.

4. The safety apparatus of claim 3, further comprising a second casing, said second casing containing said power supply and said thermistor means.

* * * * *